United States Patent [19]

Lavigne, Jr. et al.

[11] 4,141,708

[45] Feb. 27, 1979

[54] DUAL FLASH AND THERMAL ECONOMIZED REFRIGERATION SYSTEM

[75] Inventors: William J. Lavigne, Jr., Fayetteville; Louis H. Leonard, DeWitt, both of N.Y.

[73] Assignee: Carrier Corporation, Syracuse, N.Y.

[21] Appl. No.: 828,793

[22] Filed: Aug. 29, 1977

[51] Int. Cl.[2] ..... F25B 5/00; F25B 31/00; F25B 1/10

[52] U.S. Cl. ..... 62/117; 62/199; 62/505; 62/510

[58] Field of Search ..... 62/115, 117, 174, 219, 62/238, 476, 498, 504, 505, 510, 512

[56] References Cited

U.S. PATENT DOCUMENTS

| | | | |
|---|---|---|---|
| 2,277,647 | 3/1942 | Jones | 62/510 |
| 2,684,579 | 7/1954 | Hieatt et al. | 62/468 |
| 3,165,905 | 1/1965 | Ware | 62/505 |
| 3,226,940 | 1/1966 | Jekat et al. | 62/199 |
| 3,232,074 | 2/1966 | Weller et al. | 62/117 |
| 3,553,974 | 1/1971 | Osborne | 62/174 |
| 3,665,724 | 5/1972 | Anderson et al. | 62/196 |
| 4,014,182 | 3/1977 | Granryd | 62/117 |

*Primary Examiner*—Lloyd L. King

*Attorney, Agent, or Firm*—J. Raymond Curtin; Robert P. Hayter; Donald F. Daley

[57] ABSTRACT

A vapor compression refrigeration system which has a compressor, a condenser, a low temperature flash economizer, a high temperature flash economizer and a chiller connected to form a primary refrigerant loop and a second compressor and economizer condenser connected to partially form a secondary refrigerant loop. Gaseous refrigerant from the high temperature flash economizer is condensed by the economizer condenser and then flashed in the low temperature flash economizer. The gaseous refrigerant from the low temperature flash economizer is recompressed by the second compressor and thereafter recondensed by the economizer condenser. The recondensed refrigerant is then circulated to the low temperature flash economizer together with the remaining liquid refrigerant from the condenser.

18 Claims, 3 Drawing Figures

DUAL FLASH AND THERMAL ECONOMIZED REFRIGERATION SYSTEM

BACKGROUND OF THE INVENTION

1. Field of the Invention

The present invention relates to vapor-compression refrigeration systems which are adapted to cool a fluid for domestic or other uses. More particularly the present invention relates to the vapor compression refrigeration system with two compressors, the second compressor receiving flashed gaseous refrigerant from a low temperature flash economizer and recompressing that gaseous refrigerant so that it may be recondensed in a high temperature flash economizer for use within the refrigeration system.

2. Description of the Prior Art

Refrigeration systems of the vapor compression type typically employ a compressor to increase a temperature and pressure of the gaseous refrigerant. Connected thereto is a condenser wherein gaseous refrigerant is cooled so that it changes state to a liquid refrigerant. Thereafter the refrigerant may be subcooled in a flash economizer wherein part of the refrigerant is vaporized absorbing heat from the remaining liquid refrigerant. The vaporized refrigerant has been typically drawn into the compressor for recycling through the condenser and the liquid refrigerant which has now been cooled is conducted to the evaporator or chiller. In the chiller, the refrigerant is evaporated absorbing heat from the fluid to be cooled, the now gaseous refrigerant being drawn into the compressor to complete the cycle. In the above described refrigeration system, the compressor is a multistage compressor such that the flashed refrigerant from the flashed economizer may be drawn into the compressor between stages allowing the flash economizer to be at an intermediate pressure to the condenser and the chiller. The basic patent dealing with a flash economizer was issued to Jones in 1942 and is entitled "Refrigeration", U.S. Pat. No. 2,277,647. Therein the flash economizer was located between the condenser and the evaporator and the flashed gaseous refrigerant therefrom was drawn into the compressor between the first and second stages and the liquid refrigerant which has been cooled in the flashing process is allowed to travel to the evaporator.

Other types of multi-stage compressors have been used with various economizers. In Wallard, et al, 3,232,074, entitled "Cooling Means for a Dynamoelectric Machine", there is disclosed an evaporator and a condenser wherein the flash economizer is located therebetween, the flashed gas being drawn into the second stage of a two stage compressor and the liquid refrigerant passing through the condenser and to the machine for cooling of the electric motor. Other typical economizers are shown in Ware, U.S. Pat. No. 3,165,905; in Osborne, U.S. Pat. No. 3,553,974; in Hieatt, et al, U.S. Pat. No. 2,684,579; and in Anderson, et al, U.S. Pat. No. 3,665,724.

In Jeket, U.S. Pat. No. 3,226,940 an economizer is used with a centrifugal compressor having a combination impeller blade such that flashed gas from the economizer may enter the centrifugal compressor in the middle of the blade thereby creating within a single compressor two separate pressure levels. In Granryd, U.S. Pat. No. 4,014,182 a method and apparatus are disclosed wherein an economizer is utilized with a single stage compressor such that liquid refrigerant is allowed to flow from the condenser to the economizer wherein gaseous refrigerant is withdrawn into the compressor until such time as the economizer temperature reaches the desired level. At such time a valve opens allowing the refrigerant to be drawn into the chiller from which the compressor removes the flashed refrigerant gas. The compressor runs continuously however, the suction line to the compressor is cycled alternately between the economizer and the condenser such that the compressor is always withdrawing refrigerant from either the economizer or the condenser and such that the refrigerant passing from the economizer to the condenser is always at the desired temperature.

In order to use a flash economizer within an existing vapor compression system having a single stage compressor it is necessary that a second compressor be provided such that the flashed gas can be compressed. Thereafter by providing an economizer-condenser this recompressed flashed gas may be condensed to a liquid and may be reflashed to further cool itself and the liquid from the initial flash process. This system is particularly applicable to refrigerants such as R-11 which are not adaptable to sensible heat subcooling. Latent heat cooling by means of a change of state is the only practical method to subcool R-11 and other similar refrigerants.

Prior refrigeration systems utilizing a flash economizer have required a multiple stage compressor to provide varying pressure levels for the flashing to occur. Refrigeration systems of a single stage compressor have previously not been adaptable for retrofit machinery to provide a flash economizing step since the pressure differential required has not been obtainable. The refrigeration system described hereafter is adaptable to be retrofitted to a single stage centrifugal compressor system so that a second compressor may be provided to recompress flashed gas from the low temperature flash economizer. The provision of an economizer-condenser which would condense the recompressed flashed gas aids in the overall efficiency of the system.

For similar refrigeration systems to the present invention see the following patent applications filed simultaneously herewith: Dual Flash Economizer Refrigeration System, Ser. No. 828,458; Thermal Economized Refrigeration System, Ser. No. 828,449; Thermal Economized Application for a Centrifugal Refrigeration Machine, Ser. No. 828,448; Supply Water Cooling for a Refrigeration System, Ser. No. 828,810; Flash Type Subcooler, Ser. No. 828,446;.

SUMMARY OF THE INVENTION

An object of this invention is to provide an efficient refrigeration system.

A more specific object of the present invention is to provide a dual flash and thermal economized refrigeration system.

Another object of the present invention is to provide a vapor compression system wherein a refrigerant is flashed for subcooling and thereafter part of the refrigerant is recompressed and recondensed for additional subcooling.

It is another object of the present invention to provide a refrigeration system for thermal economizing of flashed liquid refrigerant in addition to the step of recompressing the flashed refrigerant.

It is another object of the present invention to cool liquid refrigerant such that the overall efficiency of a refrigeration system will be increased.

It is yet another object of the present invention to recondense recompressed refrigerant such that the recondensed refrigerant may be flashed a second time to subcool the liquid refrigerant.

It is a still further object of the present invention to provide a flash economizer system which may be incorporated into an existing vapor refrigeration system utilizing a single stage centrifugal compressor.

Other objects will be apparent from the description to follow and from the appended claims.

The preceding objects are achieved according to a preferred embodiment of the invention by the provision of a high temperature flash economizer and a low temperature flash economizer within a single stage vapor compression refrigeration system. Therein the condenser is connected to a compressor, the condenser condensing the gaseous refrigerant received from the compressor to a liquid refrigerant. A high temperature flash economizer receives liquid refrigerant from the condenser and flashes that refrigerant such that part of the refrigerant changes state to a gas absorbing heat from the remaining liquid refrigerant. The liquid refrigerant then travels to a low temperature flash economizer wherein the refrigerant is again flashed such that part of the refrigerant changes from the liquid to a gas absorbing heat from the remaining liquid refrigerant. The liquid refrigerant is then conducted to the chiller where it is used to absorb heat from the fluid to be cooled. In the chiller, the refrigerant changes state to a gas and it is then conducted to the compressor to complete the cycle. Within the high temperature flash economizer is located an economizer-condenser. The economizer-condenser is cooled with a liquid such that the gas from the flashing within the high temperature flash economizer is condensed by the economizer-condenser. The recondensed flashed gas is conducted with the remaining liquid refrigerant to the low temperature flash economizer wherein both are reflashed. The flashed gas from the low temperature flash economizer is drawn into the second compressor wherein its temperature and pressure are increased. The now recompressed refrigerant is conducted to the high temperature flash economizer wherein it is condensed by the economizer-condenser at the same time the flashed gas from flashing within the high temperature flash economizer is condensed.

BRIEF DESCRIPTION OF THE DRAWINGS

FIG. 1. is a schematic diagram of a vapor compression refrigeration system utilizing the present invention.

DESCRIPTION OF THE PREFERRED EMBODIMENT

Figure 2:
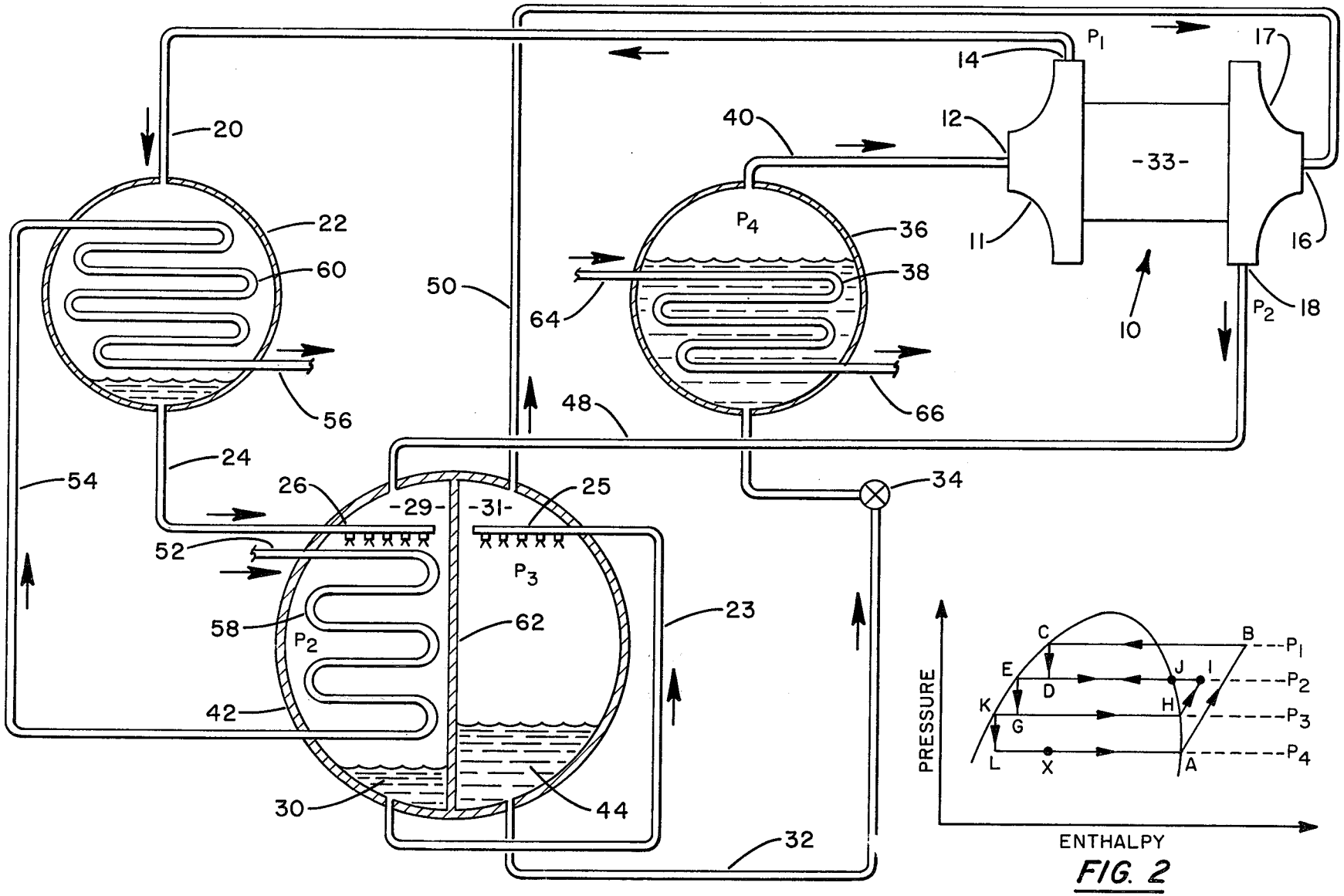
FIG. 2 is a pressure-enthalpy graph showing the refrigeration cycle of the present invention.

The embodiment of the invention described below is adapted for use in a vapor compression refrigeration system having a single stage compressor, a condenser and an evaporator or chiller. It is to be understood that the present invention finds applicability in a refrigeration system other than the single stage vapor compression refrigeration systems. The present invention is further adapted so that multiple condensers are available within a single refrigeration system. These multiple condensers may be used as disclosed herein or in other types of refrigeration systems.

Referring to FIG. 1, a schematic diagram of the vapor compression refrigeration system, it can be seen that a dual channel compressor 10 is provided having two separate centrifugal compressors 11 and 17 located on a single axis driven by an electric motor 33. A primary compressor 11 has increased temperature and pressure refrigerant gas exiting therefrom at outlet 14 into line 20. From line 20 the gaseous refrigerannt enters condenser 22 wherein it changes state to a liquid refrigerant. The liquid refrigerant is collected in the bottom of condenser 22 and then transported through line 24 to high temperature flash economizer 29. In high temperature flash economizer liquid refrigerant is flashed through nozzles 26 such that part of the refrigerant changes state to a gas absorbing heat from the remaining liquid refrigerant. Liquid refrigerant then collects at the bottom of the high temperature flash economizer shown as reservoir 30. Therefrom via line 23, the liquid refrigerant is conducted to the low temperature flash economizer wherein the liquid refrigerant is flashed through nozzles 25 such that part of the refrigerant changes state to a gas absorbing heat from the remaining liquid refrigerant. The liquid refrigerant from the low temperature flash economizer collects in reservoir 44 and is therefrom conducted via line 32 to expansion control device 34. The pressure of the liquid refrigerant is reduced in the expansion control device and therefrom the liquid refrigerant travels to chiller 36 wherein the liquid changes state to a gas absorbing heat from the fluid to be cooled as it passes through the chiller. Line 40 then conducts the gaseous refrigerant from the chiller to inlet 12 of compressor 11 wherein the gaseous refrigerant is recompressed to commence the cycle again. Flashed refrigerant gas within the high temperature flash economizer is recondensed by economizer-condenser 42 mounted therein. This recondensed liquid refrigerant is collected in reservoir 30 and is conducted therefrom to low temperature flash economizer through conduit 23 with the remaining liquid refrigerant within the high temperature flash economizer from condenser 22. The flashed refrigerant in low temperature flash economizer 31 is drawn into compressor 17 at inlet 16. Increased temperature and pressure refrigerant exits the compressor at outlet 18 and is discharged through line 48 into the high temperature flash economizer 29. Therein this recompressed refrigerant is recondensed by the economizer-condenser simultaneously with the flash gas from nozzles 26 being condensed within the high temperature flash economizer.

Within chiller 36 is located a coil 38 through which refrigerant flows. Water to be cooled enters chiller 36 through line 64 and then typically floods over coils 38 in heat exchange relationship therewith. The now cooled water exits through line 66 to the enclosure to be cooled. Connected to the economizer-condenser 42 is line 52 for supplying entering condensing water thereto and line 54 for conducting the now heated condensing water therefrom. Line 54 connects the discharge from economizer-condenser 42 with the inlet to coil 60 of condenser 22. The condensing water that enters economizer-condenser is thus serially connected to condenser 22 where it absorbs heat from the gaseous refrigerant from compressor 11 such that it changes state from a gas to a liquid. The condensing water then exits from condenser coil 60 through conduit 56. Additional condensing water may be supplied to condenser 22 depending upon the load requirements.

Compressor 11 increases the pressure of the gaseous refrigerant to $P_1$. Thereafter the pressure of the refrigerant is decreased in the high temperature flash economizer to $P_2$. The refrigerant is then flashed in the low temperature flash economizer which operates at pressure $P_3$. Therefrom flashed refrigerant is drawn into compressor 17 where its pressure is increased to $P_2$. Liquid refrigerant exits the low temperature flash economizer at $P_3$ and travels to the expansion control device wherein its pressure is reduced to $P_4$. The refrigerant travels through the chiller and enters compressor 11 at $P_4$ wherein its pressure again is increased to $P_1$.

FIG. 2 is a graph of a pressure versus enthalpy for a typical refrigerant such as R-11 which is used within this system. Starting at point A thereon it can be seen that the pressure and enthalpy of the refrigerant is increased from point A to point B, said distance representing the change in pressure and enthalpy due to the increase in pressure and temperature by compressor 11 acting on the refrigerant. From point B to C represents the change in enthalpy in condenser 22 as the gaseous refrigerant changes state to a liquid refrigerant. Thereafter in the high temperature flash economizer the refrigerant travels from point C to point D representing the pressure decrease as the refrigerant is flashed. From point D the liquid refrigerant is cooled to point E and the gaseous refrigerant is heated to point J as it absorbs heat from the cooled liquid refrigerant. The economizer-condenser acts to thermally cool the refrigerant at point J such that the gaseous refrigerant from J becomes liquid refrigerant at point E.

In the low temperature flash economizer the liquid refrigerant is decreased in pressure from point E to point G, during this drop in pressure part of the refrigerant vaporizes absorbing heat from the remaining liquid refrigerant, the liquid refrigerant going from point G to point K and the gaseous refrigerant from point G to point H. Compressor 17 acting on the refrigerant at point H increases its pressure and enthalpy to point I. This recompressed refrigerant is then recondensed by the economizer-condenser traveling from point I to point E. The recompressed refrigerant then travels to the low temperature flash economizer wherein it is recycled to the pressure of point G. Liquid refrigerant at point K is decreased in pressure at the expansion control device to point L. In the chiller heat is absorbed from the fluid to be cooled and the amount of heat to be absorbed is proportionate to the distance from point L to point A, point A being the starting point of the cycle. As can be seen in FIGS. 1 and 2, $P_1$, $P_2$, $P_3$ and $P_4$ are indicated on both showing the respective pressure relationships.

In the pressure-enthalpy diagram the left portion of the curve indicates the pressure enthalpy line at which the liquid refrigerant is 100% saturated. The right side of the curve indicates the pressure enthalpy line at which gaseous refrigerant is 100% saturated. The area between the two lines indicates a two phase mixture of liquid and vapor.

In order to obtain the most cooling work from a given amount of refrigerant it is desirable to cool the refrigerant as close as possible to the left side of the curve such that when the refrigerant is flashed in the chiller as much heat as possible indicated by the distance from L to A is absorbed from the refrigerant to be cooled. Without the dual stage flash and thermal economizer it is obvious that the heat available to be absorbed by the refrigerant is proportional to the distance represented in the graph by the line from X to A, point X being the point to which the refrigerant would travel from point C if the pressure were decreased to $P_4$ in one step. By the provision of the dual flash and thermal economizer the refrigerant is cooled to point L allowing the heat to be absorbed from the refrigerant to be increased to be proportional to the distance indicated by the line L to A. This increase in the length from distance XA to distance LA represents an overall efficiency increase in the amount of heat that may be absorbed within the refrigeration system.

For optimization of this dual flash economized and thermal economized refrigeration system, the entering condensing water is circulated first to the ecconomizer-condenser and then through main condenser 22. The economizer-condenser operates at a temperature considerably lower than the main condenser and consequently the cooling water is advantageously used by being circulated first through the economizer-condenser and then through the main condenser. Of course, additional condensing water may be supplied to to the main condenser to meet the load thereon.

The high temperature flash economizer and the low temperature flash economizer are shown each mounted within half of a cylinder in FIG. 1. The cylinder is divided by center plate 62 into the low temperature flash economizer and a high temperature flash economizer which operate at separate pressures. Refrigerant travels through line 23 from the high temperature flash economizer to the low temperature flash economizer and also travels through the line 50, compressor 17 and line 48 from the low temperature flash economizer to the high temperature flash economizer. This physical arrangement is described merely to indicate that the high temperature flash economizer and the low temperature flash economizer may be fitted within a portion of the conventional refrigeration machine utilizing cylindrical pressurized compartments. Furthermore this arrangement is described to indicate that the economizer-condenser may be physically located within the pressure vessel making up the high temperature flash economizer.

The preferred embodiment above described has revealed an improved vapor compression refrigeration system utilizing two compressors to increase the efficiency of operation of the refrigeration system together with thermal economizing apparatus. Particularly the system has been shown which may be adapted to be used with the previously installed single stage vapor compression refrigeration system to increase the efficiency thereof.

Figure 3:
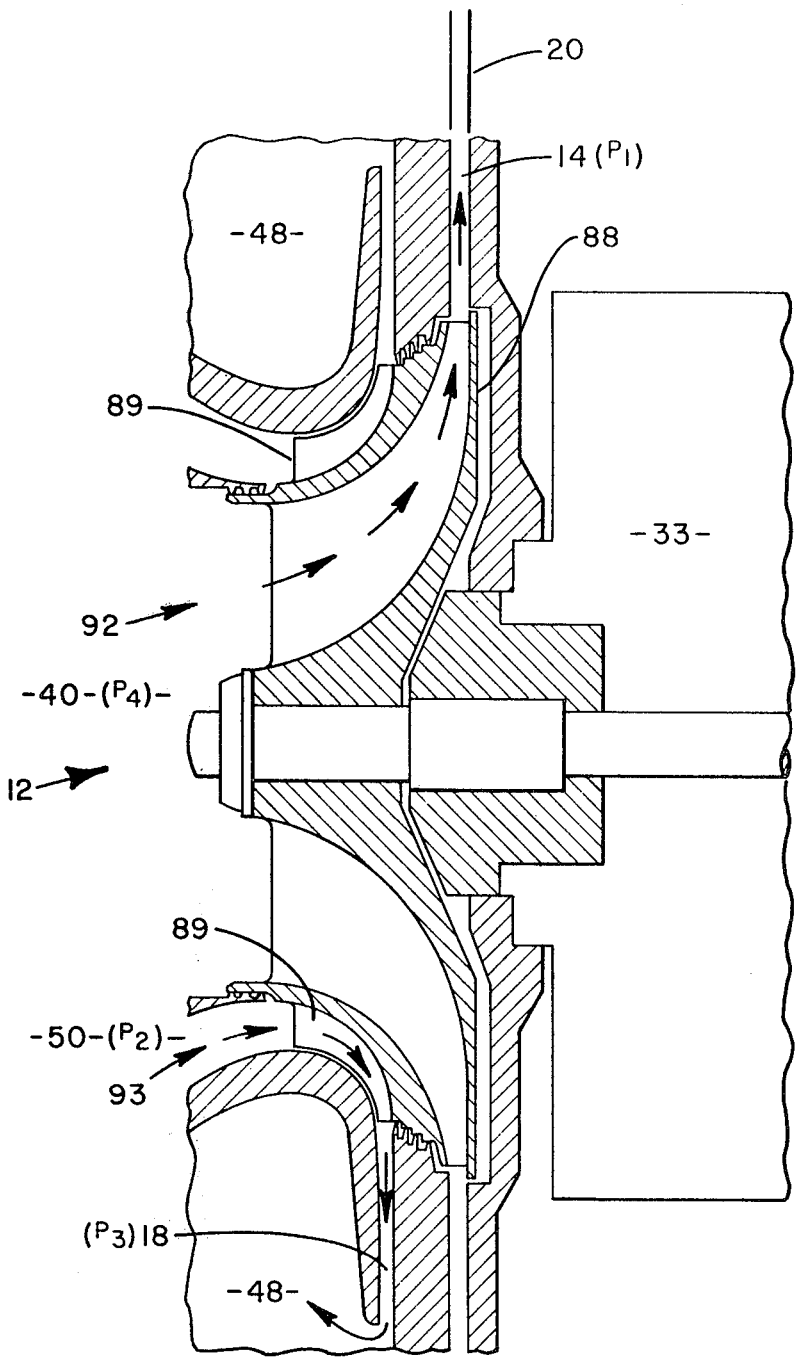
FIG. 3 is a schematic diagram of a "piggyback" compressor for use with the refrigeration system of FIG. 1.

Referring now to FIG. 3, a schematic drawing of a "piggyback" compressor, it can be seen that this "piggyback" compressor may be advantageously utilized within the above described vapor compression refrigeration system. A motor 33 is mounted to drive primary impeller 88 and secondary impeller 89. The secondary impeller is mounted to primary impeller 88 such that when the motor drives the primary impeller, the secondary impeller will also be driven. However, the secondary impeller is mounted on the primary impeller in such a manner that the flow paths of the refrigerant being compressed by the primary impeller and the secondary impeller are separated by cover or shroud 91 of the primary impeller. The primary impeller is a closed type impeller since shroud 91 is located thereon. The word "piggyback" in reference to this compressor refers to the fact that the secondary impeller is mounted to the primary impeller such that when one operates the other operates. The schematic diagram shown in FIG. 3 is designed to be compatible with the system shown in FIG. 2 having the "piggyback" compressor of FIG. 3 substituted for the dual compressors of FIG. 1.

As shown in FIG. 3, the primary impeller 88 receives refrigerant at pressure $P_4$ through conduit 40 at inlet 12. The refrigerant then proceeds along the primary flow path 92 and has its temperature and pressure increased as it flows along said path. The now increased temperature and pressure refrigerant is discharged at outlet 14 into conduit 20 at pressure $P_1$. Simultaneously therewith, refrigerant is received through conduit 50 into inlet 16 at pressure $P_2$. The refrigerant enters the secondary impeller through inlet 16 and travels along secondary flow path 93. The refrigerant is then discharged from secondary impeller 89 through outlet 18 into conduit 48, the refrigerant pressure then being at $P_3$.

Referring now to the combination of FIGS. 2 and 3, it can be seen that the refrigerant entering the primary impeller through conduit 40 is the flashed gaseous refrigerant coming from chiller 36. The refrigerant being discharged from primary impeller 88 into conduit 20 travels to the condenser 22. The refrigerant received from conduit 50 at pressure $P_2$ is the flashed gaseous refrigerant from the flash economizer 28. The refrigerant being discharged through outlet 18 into conduit 48 from the secondary impeller travels to the economizer-condenser. As can be seen from the above description, the "piggyback" compressor may be substituted for the dual channel compressor shown in FIG. 2.

The invention has been described in detail with particular reference to the preferred embodiment thereof but it will be understood that variations and modifications can be effected within the spirit and the scope of the invention.

What is claimed is:

1. A vapor compression refrigeration system using a refrigerant for cooling a fluid which comprises:

a first compressor for increasing the temperature and pressure of the gaseous refrigerant;

a condenser connected to the compressor wherein the refrigerant changes state from a gas to a liquid;

a high temperature flash economizer connected to the condenser wherein liquid refrigerant is flashed from a high pressure to a low pressure and part of said refrigerant changes state from a liquid to a gas and absorbing heat from the remaining liquid refrigerant;

an economizer-condenser in communication with the gaseous refrigerant from the high temperature flash economizer for cooling said gaseous refrigerant to change its state from a gas to a liquid;

a low temperature flash economizer which receives liquid refrigerant from the high temperature flash economizer wherein said liquid refrigerant is flashed so that part of the refrigerant changes state from a liquid to a gas absorbing heat from the remaining liquid refrigerant;

a second compressor connected to the low temperature flash economizer so that the flashed refrigerant therefrom is drawn into the second compressor where the temperature and pressure of the flashed refrigerant is increased;

connecting means between the second compressor and the high temperature flash economizer wherein the gaseous refrigerant from the second compressor is delivered to the high temperature flash economizer wherein the economizer-condenser is utilized to change the gaseous refrigerant to a liquid refrigerant; and a chiller for cooling the fluid, said chiller receiving liquid refrigerant from the low temperature flash economizer and discharging gaseous refrigerant to the first compressor.

2. The invention as set forth in claim 1 wherein the high temperature flash economizer and the low temperature flash economizer are contained in a single cylindrical shell divided by a center plate into two portions, one for the high temperature flash economizer and one for the low temperature flash economizer.

3. The invention as set forth in claim 1 wherein the economizer-condenser is mounted within the high temperature flash economizer in communication with both the flashed gaseous refrigerant from the condenser and the compressed gaseous refrigerant from the second compressor.

4. The invention as set forth in claim 1 wherein the first compressor is a primary channel of a dual channel centrifugal compressor and the second compressor is the secondary channel of the same dual channel centrifugal compressor.

5. The invention as set forth in claim 1 wherein the economizer-condenser and the main condenser are cooled by condenser water which is circulated in series through the economizer-condenser and then through the main condenser so that the economizer-condenser receives the lowest temperature condensing water.

6. A vapor compression refrigeration system utilizing a refrigerant to cool a fluid which comprises:

a primary refrigerant loop having:

(a) a first compressor for discharging refrigerant at increased temperature and pressure;

(b) a condenser connected to receive the refrigerant from the first compressor wherein the refrigerant is converted from a gas to a liquid;

(c) a high temperature flash economizer connected to the condenser wherein the liquid refrigerant is partially flashed to a gaseous refrigerant absorbing heat from the remaining liquid refrigerant;

(d) a low temperature flash economizer connected to the high temperature flash economizer wherein the liquid refrigerant from the flash economizer is partially reflashed to a gaseous refrigerant absorbing heat from the remaining liquid refrigerant;

(e) an expansion control device connected to receive liquid refrigerant from the low temperature flash economizer wherein the refrigerant pressure is reduced; and (f) a cooler that receives refrigerant from the expansion control device and discharges refrigerant to the first compressor, wherein at least part of said refrigerant changes state from a liquid to a gas to absorb heat from the fluid to be cooled; and a secondary refrigerant loop having:

(a) a second compressor connected to receive flashed gaseous refrigerant from the low temperature flash economizer;

(b) an economizer-condenser connected to receive gaseous refrigerant from the second compressor wherein the state of refrigerant is changed from a gas to a liquid simultaneously with the gas from the high temperature flash economizer being changed from a gas to a liquid, the liquid refrigerant both from the condenser and the second compressor then being connected to the low temperature flash economizer of the primary refrigerant loop.

7. The invention as set forth in claim 6 wherein the first compressor and the second compressor comprise a single centrifugal compressor having dual channels, one channel for the primary refrigeration loop and one channel for the secondary refrigeration loop.

8. The invention as set forth in claim 6 wherein the economizer-condenser and the condenser are both cooled by cooling water, said cooling water flowing first to the economizer-condenser and then to the main condenser.

9. The invention as set forth in claim 6 wherein the economizer-condenser is located within the high temperature flash economizer and in communication with both the gaseous refrigerant from the main condenser and from the second compressor.

10. A flash gas refrigeration loop for use in a refrigeration system having a high temperature flash economizer and a low temperature flash economizer connected in series through which a refrigerant circulates which comprises:

a compressor connected to receive gaseous refrigerant from the low temperature flash economizer; and an economizer-condenser connected to receive hot gaseous refrigerant from the compressor wherein said refrigerant is cooled so that it changes state from a gas to a liquid.

11. A method of cooling a fluid within a refrigeration system utilizing a refrigerant which comprises:

compressing the gaseous refrigerant to increase its temperature and pressure;

condensing the gaseous refrigerant to a liquid refrigerant;

flashing the refrigerant so that part of the liquid refrigerant changes state from a liquid to a gas absorbing heat from the remaining liquid refrigerant;

condensing the gaseous refrigerant from the step of flashing to a liquid;

reflashing the liquid refrigerant in a low temperature flash economizer;

recompressing the flash gas from the step of reflashing;

recondensing the gaseous refrigerant received from the step of recompressing simultaneously with the step of condensing the gaseous refrigerant from the step of flashing; and evaporating the liquid refrigerant in a heat exchanger to absorb heat from the liquid to be cooled wherein the refrigerant changes state from a liquid to a gas so that the refrigerant may be cycled to the step of compressing.

12. An improved method within a refrigeration system having a refrigerant loop including a high temperature flash economizer and a low temperature flash economizer wherein the pressure of the refrigerant is reduced in each so that part of the liquid refrigerant changes state to a gas absorbing heat from the remaining liquid refrigerant, comprising the steps of compressing the gaseous refrigerant from the flash economizer and condensing the gaseous refrigerant received from the step of compressing from a gas to a liquid, said condensing occurring in communication with both the gaseous refrigerant from the compressor and the flash gas from the high temperature flash economizer so that both gases are simultaneously condensed to a liquid.

13. The method as set forth in claim 12 wherein the high temperature flash economizer has located therein the economizer-condenser.

14. A vapor compression refrigeration system using a refrigerant for cooling a fluid which comprises:

a compressor system having a primary impeller for increasing the temperature and pressure of the refrigerant and a secondary impeller mounted to the primary impeller but having a separate flow path therefrom also for increasing the temperature and pressure of the refrigerant;

a condenser connected to receive increased temperature and pressure refrigerant from the primary impeller wherein the refrigerant changes state from a gas to a liquid;

a high temperature flash economizer connected to the condenser wherein liquid refrigerant is flashed from a high pressure to a low pressure and part of said refrigerant changes state from a liquid to a gas absorbing heat from the remaining liquid refrigerant;

an economizer condenser in communication with the gaseous refrigerant from the high temperature flash economizer for cooling said gaseous refrigerant to change its state from a gas to a liquid;

a low temperature flash economizer which receives liquid refrigerant from the high temperature flash economizer wherein said liquid refrigerant is flashed so that part of the refrigerant changes state from a liquid to a gas absorbing heat from the remaining liquid refrigerant;

connecting means connecting the secondary impeller to the low temperature flash economizer so that the flashed refrigerant therefrom is drawn into the secondary impeller wherein the temperature and pressure of the flashed refrigerant is increased;

conducting means between the secondary impeller and the high temperature flash economizer wherein the gaseous refrigerant from the secondary impeller is delivered to the high temperature flash economizer wherein the economizer condenser is utilized to change the gaseous refrigerant to the liquid refrigerant; and a chiller for cooling of fluid said chiller receiving liquid refrigerant from the low temperature flash economizer and discharging gaseous refrigerant to the primary impeller.

15. The invention as set forth in claim 14 wherein the high temperature flash economizer and the low temperature flash economizer are contained in a single cylindrical shell divided by a center plate into two portions, one for the high temperature flash economizer and one for the low temperature flash economizer.

16. The invention as set forth in claim 15 wherein the economizer-condenser is mounted within the high temperature flash economizer in communication with both the flashed gaseous refrigerant from the condenser and the compressed gaseous refrigerant from the second compressor.

17. The invention as set forth in claim 14 wherein the primary impeller and a secondary impeller are powered by a single motor and wherein the primary impeller has a flow path of refrigerant entering therein and being discharged therefrom which is separate from the refrigerant flow path of the secondary impeller.

18. The invention as set forth in claim 14 wherein the economizer-condenser and the main condenser are cooled by condenser water which is circulated in series through the economizer-condenser and then through the main condenser so that the economizer-condenser receives the lowest temperature condensing water.

* * * * *